US006247520B1

(12) United States Patent
Girardin et al.

(10) Patent No.: US 6,247,520 B1
(45) **Date of Patent: *Jun. 19, 2001**

(54) POURING TABLE DIE BLOCK POSITIONING DEVICE FOR AN UPHILL VERTICAL CONTINUOUS CASTING MACHINE

(75) Inventors: Denis Girardin; Fabien Arnould, both of Maidieres; Yvan Morcel, Viterne, all of (FR)

(73) Assignee: Pont -A-Mousson S.A., Nancy (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/214,293

(22) PCT Filed: Jul. 11, 1997

(86) PCT No.: PCT/FR97/01299

§ 371 Date: May 6, 1999

§ 102(e) Date: May 6, 1999

(87) PCT Pub. No.: WO98/03288

PCT Pub. Date: Jan. 29, 1998

(30) Foreign Application Priority Data

Jul. 17, 1996 (FR) ..... 96 08959

(51) Int. Cl.[7] ..... B22D 11/00; B22D 11/14

(52) U.S. Cl. ..... 164/418; 164/484; 164/421

(58) Field of Search ..... 164/418, 441, 164/442, 459, 484, 421, 464, 465, 483

(56) References Cited

U.S. PATENT DOCUMENTS 3,075,264 * 1/1963 Wognum ..... 164/418
3,550,672 * 12/1970 Fastert et al. ..... 164/273
3,559,720 * 2/1971 Vogel et al. ..... 164/273
3,875,991 * 4/1975 Korshunov et al. ..... 164/147
3,967,362 * 7/1976 Capriotti et al. ..... 29/407
4,129,174 * 12/1978 Holleis et al. ..... 164/443
4,148,351 * 4/1979 Epps ..... 164/150
4,362,206 * 12/1982 Cordella et al. ..... 164/448
4,456,053 * 6/1984 Gourmel ..... 164/421
4,632,174 * 12/1986 Pierrel ..... 164/421
4,779,670 * 10/1988 Koskinen et al. ..... 164/459

FOREIGN PATENT DOCUMENTS

1357949 * 7/1964 (FR) .
WO 94/26444 * 11/1994 (WO) .

* cited by examiner

*Primary Examiner*—Kuang Y. Lin
*Assistant Examiner*—Kevin P. Kerns
(74) *Attorney, Agent, or Firm*—Sughrue, Mion, Zinn, Macpeak & Seas, PLLC

(57) ABSTRACT

The invention relates to a device for positioning a die block (5) of a casting table (1) of a continuous vertical ascendant casting machine for pipes (T) with respect to a vertical axis of extraction (X—X), the die block (5) of the machine being fed by means of a device (3) for the supply of liquid iron, and bearing thereon. This positioning device comprises a retractable support (15) in which the die block (5) is fixed, a movable frame (6) on which the device (3) supplying liquid iron stands, means (18, 19) for relative positioning of support (15) with respect to frame (6), immobilising members (21, 25) designed to immobilise the relative position between support (15) and frame (6) in such a way that support (15), frame (6) and device (3) for the supply of liquid iron form an integral assembly, a base (40) arranged in a predetermined way with respect to the vertical extraction axis (X—X) which is designed to support the integral assembly, and means (47, 60, 64) for aligning the axis (Y—Y) of the die block (5) and the vertical extraction axis (X—X).

10 Claims, 4 Drawing Sheets

POURING TABLE DIE BLOCK POSITIONING DEVICE FOR AN UPHILL VERTICAL CONTINUOUS CASTING MACHINE

BACKGROUND OF THE INVENTION

1. Field of the Invention

This invention relates to the casting of molten metals, and more particularly to the continuous vertical ascendant casting of metal components, such as cast iron pipes. Although the present invention applies to the casting of various types of metal components, it is particularly advantageous for the casting of thin-walled, cast iron pipes. The expression "thin-walled pipes" refers to pipes having a small thickness/diameter ratio, e.g., less than 10%, rather than the thickness considered by itself in isolation.

2. Description of the Related Art

The invention relates more specifically to a device for positioning a die block in a machine for the continuous vertical ascendant casting of cast iron pipes with respect to a vertical extraction axis. Such a casting machine incorporates a die block and a device for the supply of liquid iron which feeds the die block through the lower end thereof. Such a supply device is, for example, described in document FR-A-2 705 259 in the name of the Applicant. This device for the supply of liquid iron comprises a U-shaped siphon unit manufactured from cast refractory concrete, on which outlet the die block rests.

Given the high temperatures involved in the casting of molten metals, such a siphon unit becomes progressively worn and/or consumed by the molten iron which is in contact with it during the continuous casting process. In addition to this, when casting is stopped, solidification of the cast iron bursts the siphon unit.

As a consequence, this siphon unit must be replaced as a whole as soon as a particular number of pipes have been cast, i.e., is at every shut-down.

Given that the siphon unit is a relatively massive component, and given its location on the casting table of a casting machine in a pipe production system, in-situ replacement of the siphon unit is very difficult, if not impossible. For this reason, the entire casting table has to be removed from the pipe production system in order that it can be dismantled and the siphon easily replaced.

Furthermore, to shorten the length of the interruption in the manufacture of pipes several identical casting tables are used alternately. When a siphon unit on one of the casting tables has to be replaced, another is installed in the pipe manufacturing system.

However, when a casting table is replaced, alignment between the die and the vertical axis along which the pipes are extracted gives rise to a problem. In fact, the die block must be precisely aligned with the vertical extraction axis if the pipe manufacturing system to operate correctly. Now, given that the casting table has been completely dismantled, this alignment between the die block and the extraction axis is difficult and takes up a great deal of time, in particular on account of the uncertain geometry of the refractory material parts used.

SUMMARY OF THE INVENTION

The purpose of this invention is to overcome this problem of positioning the die block with respect to the vertical extraction axis by providing a die block positioning device through which rapid and precise alignment between the die block and the vertical extraction axis can be achieved in order to reduce the length of interruptions in pipe manufacture.

With this object the invention relates to a device for positioning a die block of a casting table of a machine for the continuous vertical ascendant casting of parts, in particular, pipes of cast iron, with respect to a vertical extraction axis, in which machine the die block is fed via its lower end by a device for the supply of liquid iron and bears thereupon, a positioning device characterized in that it comprises a retractable support in which the die block is fixed, a movable frame on which the device for supply of the liquid iron is placed, means for relative positioning of the support with respect to the frame, immobilizing means intended to immobilize the relative position between the support and the frame in such a way that the support and the frame form an integral assembly, a base arranged in a predetermined way with respect to the vertical extraction axis, which is designed to support the integral assembly, and means for aligning the axis of the die block and the vertical extraction axis.

The device according to the invention comprises one or more of the following features:

- the positioning means comprise at least two elongated members which are integral with the support and corresponding guide members which are attached to the frame and which are each designed to receive an elongated member, or vice versa, the said members forming in particular short column and ball-bearing socket assemblies,
- at least one immobilizing member is a jack, in particular a fluid-operated jack, connected to both the support and the frame,
- at least one end of each jack is connected to the support and/or the frame by means of a mounting and a removable gudgeon to fix the end of the jack in the mounting,
- the alignment means comprise means for relative positioning of the frame with respect to the base and means for adjusting the integral assembly horizontally,
- the means for relative positioning of the frame with respect to the base comprise at least a centering member, which is integral with the base, and projects therefrom in the direction of the frame, and a corresponding receiving member which is integral with the frame, or vice versa,
- the member for centering or integral acceptance of the frame is aligned with the axis of the die block and the member associated integrally with the base is aligned with the vertical extraction axis,
- the means for horizontal adjustment comprise several supporting jacks distributed over the lower surface of the integral assembly,
- at least one supporting jack is a screw jack.

The invention also relates to a casting table for a machine for the continuous vertical ascendant casting of parts, in particular, pipes of cast iron, a casting table in which the die block is fed via its lower end by a device for the supply of liquid iron and bears thereupon, characterized in that it comprises a positioning device as defined above.

BRIEF DESCRIPTION OF THE DRAWINGS

Other features and advantages of the invention will be apparent from the following description which is given by way of a non-restrictive example with reference to the appended drawings in which.

DETAILED DESCRIPTION OF THE INVENTION

Figure 1:
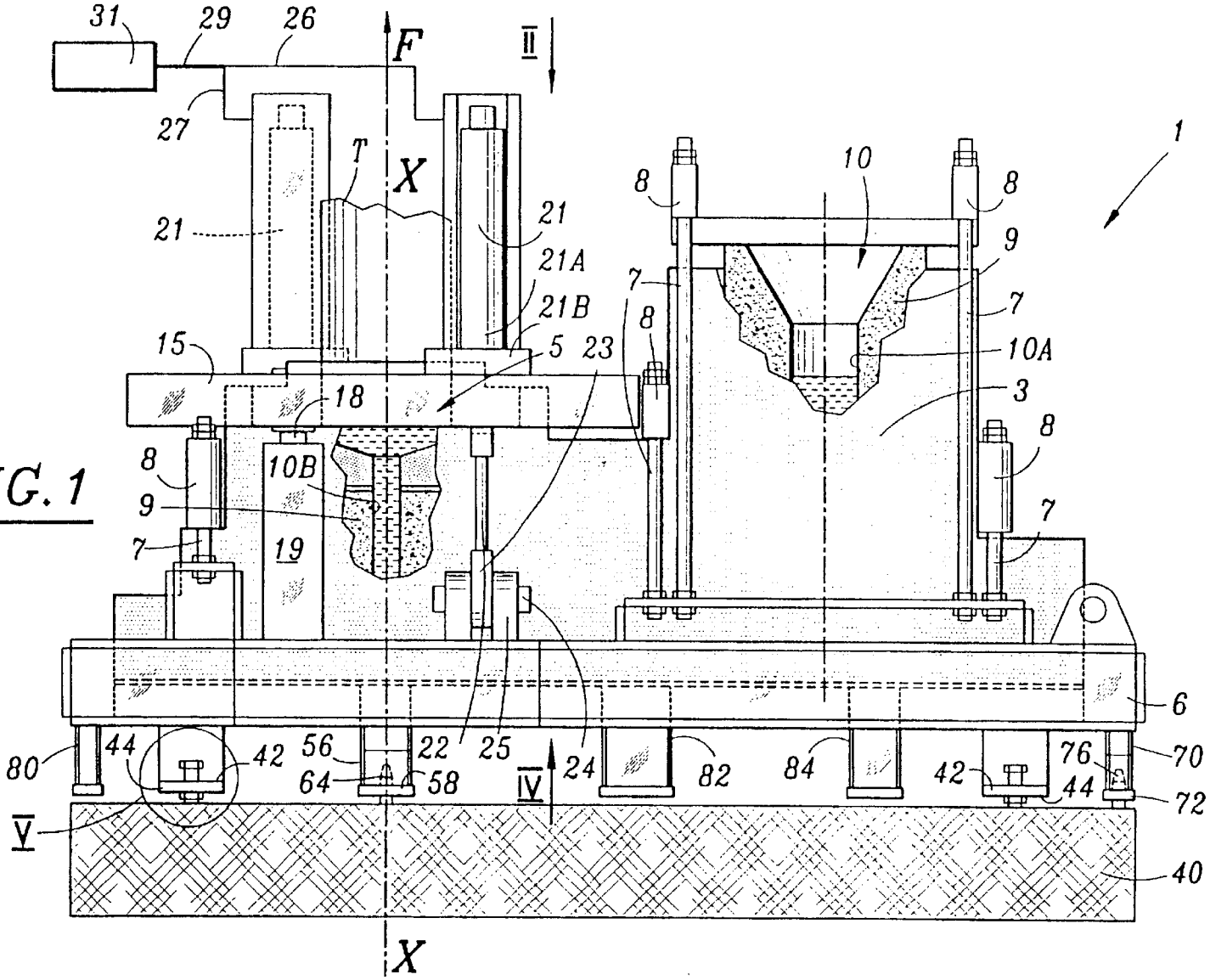
FIG. 1 is a side view of a casting table according to the invention, with a first cut-away at the inlet to the device for the supply of liquid iron and a second cut-away at the outlet from this device.

FIG. 1 shows a casting table 1 of a machine for the continuous vertical ascendant casting of parts, in particular pipes T, made of cast iron. This table comprises a device 3 for the supply of liquid iron and a die block 5 fed through its lower end by this supply device 3. The pipe T is extracted from the die block 5 by extraction means which are not shown, in an upward direction, along the vertical extraction axis X—X. The direction of the extraction force is represented by an arrow F.

The device 3 for the supply of liquid iron is placed on a frame 6 and is prevented from making lateral and vertical movements thereon by vertical tie bars 7 and horizontal cross-members 8. It incorporates a U-shaped siphon 9 which is constructed in a single piece from cast refractory concrete.

This siphon 9 incorporates a molten iron feed conduit 10 comprising a vertical descending part 10A for entry of the molten iron, a horizontal part (which cannot be seen in the figures) and a vertical part 10B through which the upwardly directed liquid iron exits.

Figure 3:
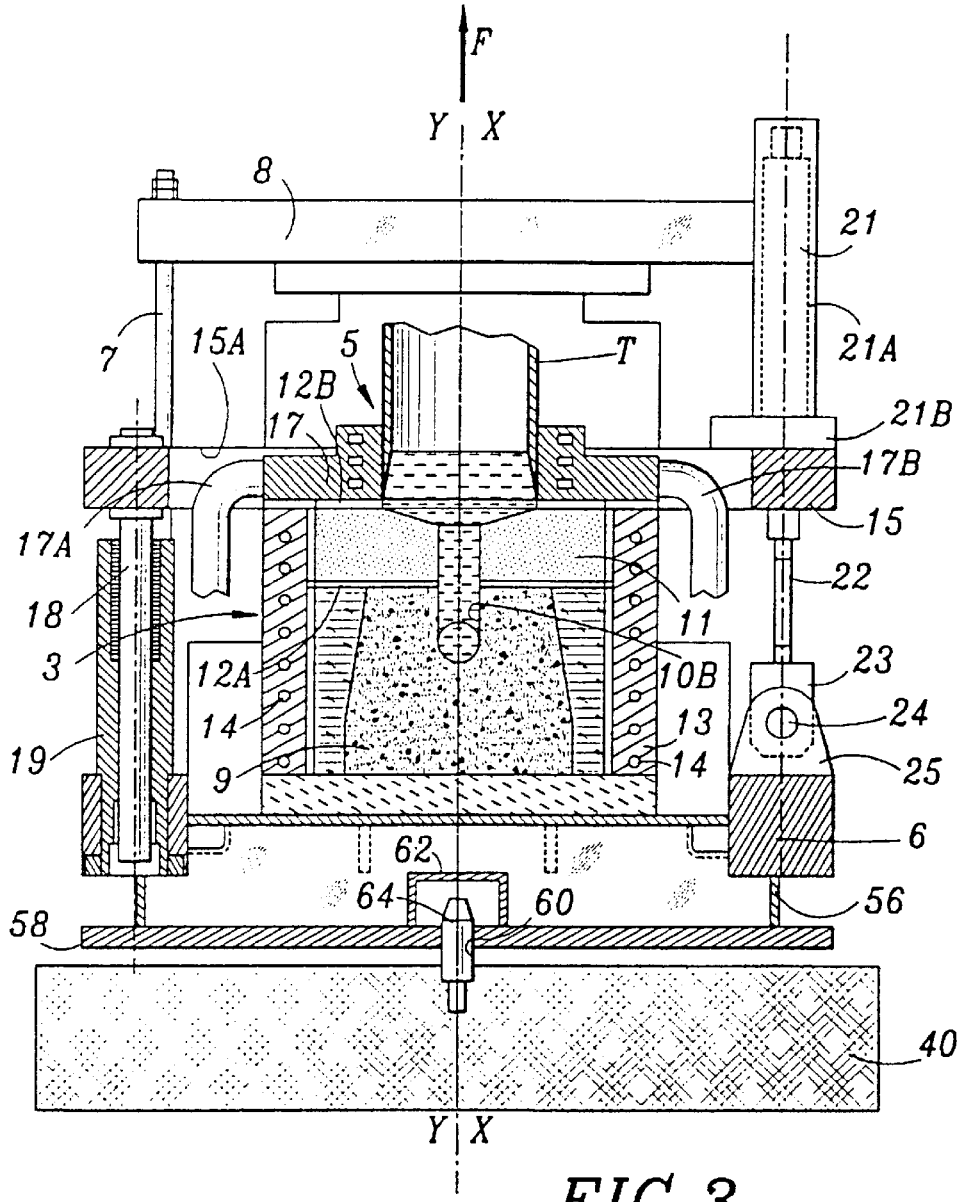
FIG. 3 is a view in transverse cross-section along the line III—III in FIG. 2.

With reference to FIG. 3, it will be seen that a heating base 11 is placed between the die block 5 and the siphon outlet 9. A seal for the molten metal is provided by two annular sealing gaskets 12A and 12B, the first gasket 12A being located between the outlet of siphon 9 and heating base 11, and the second gasket 12B being located between the heating base 11 and the die block 5.

In addition to this, the siphon 9 and the heating base 11 are surrounded by a shell 13 in the thickness of which induction coils 14 are embedded. These induction coils 14 are provided with electrical current by an external generator, which is not shown, in order to keep the iron molten as a result of induction heating.

The die block 5 is fixed in a retractable support 15 in the form of a platen. This die block 5 comprises a cooling unit 17 linked to a cooling fluid circuit by inlet pipe 17A and outlet pipe 17B. On its upper surface, cooling unit 17 has an extension of reduced diameter. This enters a matching receptacle 15A in the support 15 having vertical axis Y—Y and is fixed by means of a crown of axial bolts 15B (FIG. 2).

Figure 2:
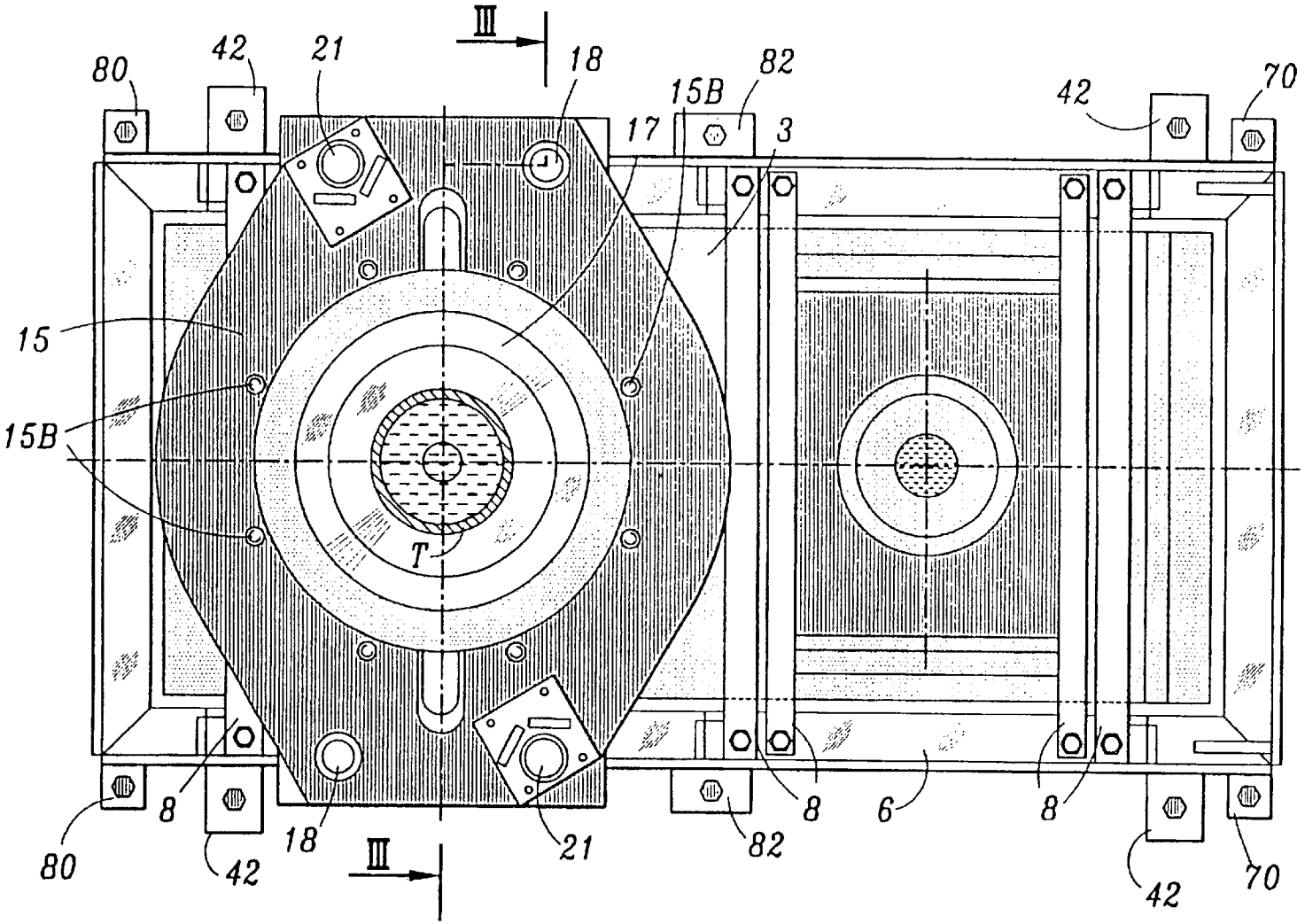
FIG. 2 is a view of the casting table from above, in the direction of arrow II in FIG. 1.

The relative position of the support 15 with respect to the frame 6 is determined by two downwardly directed short columns 18, fixed to the support 15 in a diametrically opposite fashion with respect to the die block 5, as shown in FIG. 2. FIG. 3 shows that each short column 18 is guided in an associated socket 19, provided with ball-bearings, which is fixed to the frame 6.

Because the short columns 18 acting in conjunction with the ball-bearing sockets 19 are used, the relative position of the support 15 with respect to the frame 6, and as a result the relative position of the die block 5 with respect to the frame 6, are precisely defined in a plane perpendicular to the vertical extraction axis X—X, while the support/frame distance can be adjusted parallel to the axis X—X.

In order to immobilize the position of the support 15 in relation to the axis X—X with respect to the frame 6, two fluid-operated jacks 21, e.g., hydraulic jacks or pneumatic jacks, are fixed in diametrically opposite positions on the support 15 (FIG. 2). As illustrated in FIG. 3, each jack 21 comprises a rod 22 whose free end 23 is fixed by a gudgeon 24 in a mounting 25 which is integral with the frame 6. Each gudgeon 24 is secured in the mounting 25 by pins (not shown) so that the support 15 can be easily dismantled from the frame 6. The bodies 21A of the jacks 21 are fixed to the upper surface of the support (platen) 15 by a collar 21B.

As may be seen in FIG. 1, each fluid-operated jack 21 is connected by a conduit 26, 27 to a common conduit 29. This common conduit 29 is connected to a hydraulic unit 31 which regulates the force with which each jack is tightened, and is shown diagrammatically. Advantageously this hydraulic unit is also mounted on the frame 6.

Once the position of the support 15 with respect to the frame 6 has been immobilized by the jacks 21, the support and the jacks, in addition to the die block 5 and the supply device 3, form a rigid integral assembly.

Figure 5:
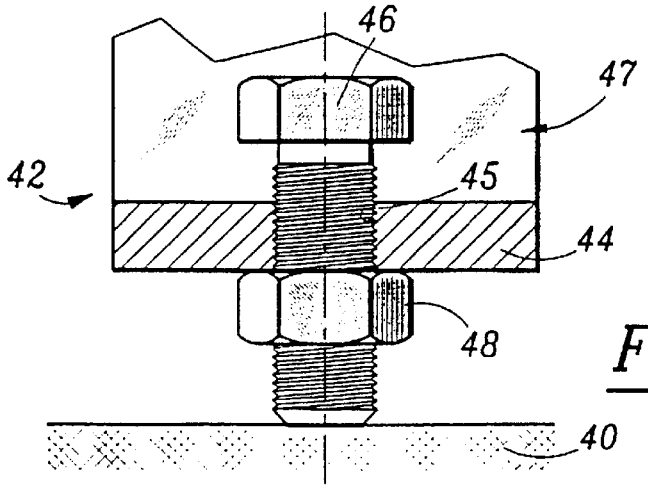
FIG. 5 is a view on an enlarged scale of detail V in FIG. 1.

The frame 6 rests on a fixed base 40 at four points of support. For this purpose, the frame 6 has two horizontal supporting cross-members 42 of square cross-section on its underside. As may be seen in FIG. 2, these cross-members 42 are longer than the width of the frame 6 and extend beyond the frame at the sides. As shown in FIG. 5, the cross-members 42 each have a threaded hole 45 in each of their terminal zones, in a wall 44 which is opposite base 40. A supporting bolt 46 is screwed into the hole 45 and forms therewith a jack 47 providing horizontal adjustment for the frame. The bolt 46 is prevented from rotating prematurely by a lock nut 48. It will be understood therefore that the frame rests on the base 40 through the lower ends of the four bolts 46.

In order that the Y—Y axis of die block 5 can be accurately positioned with respect to axis X—X for the extraction of the pipe T, the frame 6 also comprises a horizontal centering cross-member 56 of square cross-section on its underside. With reference to FIG. 3, this centering cross-member 56 has a wall 58 opposite the base 40 in which a centering hole 60 is provided. This centering hole 60 is centered with respect to the Y—Y axis of the die block 5. A protective cover 62 is located above the centering hole 60.

This centering hole 60 acts together without appreciable play with a centering pin 64 which is integral with the base 40. The base 40 is arranged in such a way that the vertical axis of the centering pin 64 is aligned with the extraction axis X—X of the extraction means.

Cooperation between this centering pin 64 and the centering hole 60 makes it possible to bring a point on the axis of revolution Y—Y of the die block 5 to coincide with the point on the vertical extraction axis X—X of the extraction means.

Figure 4:
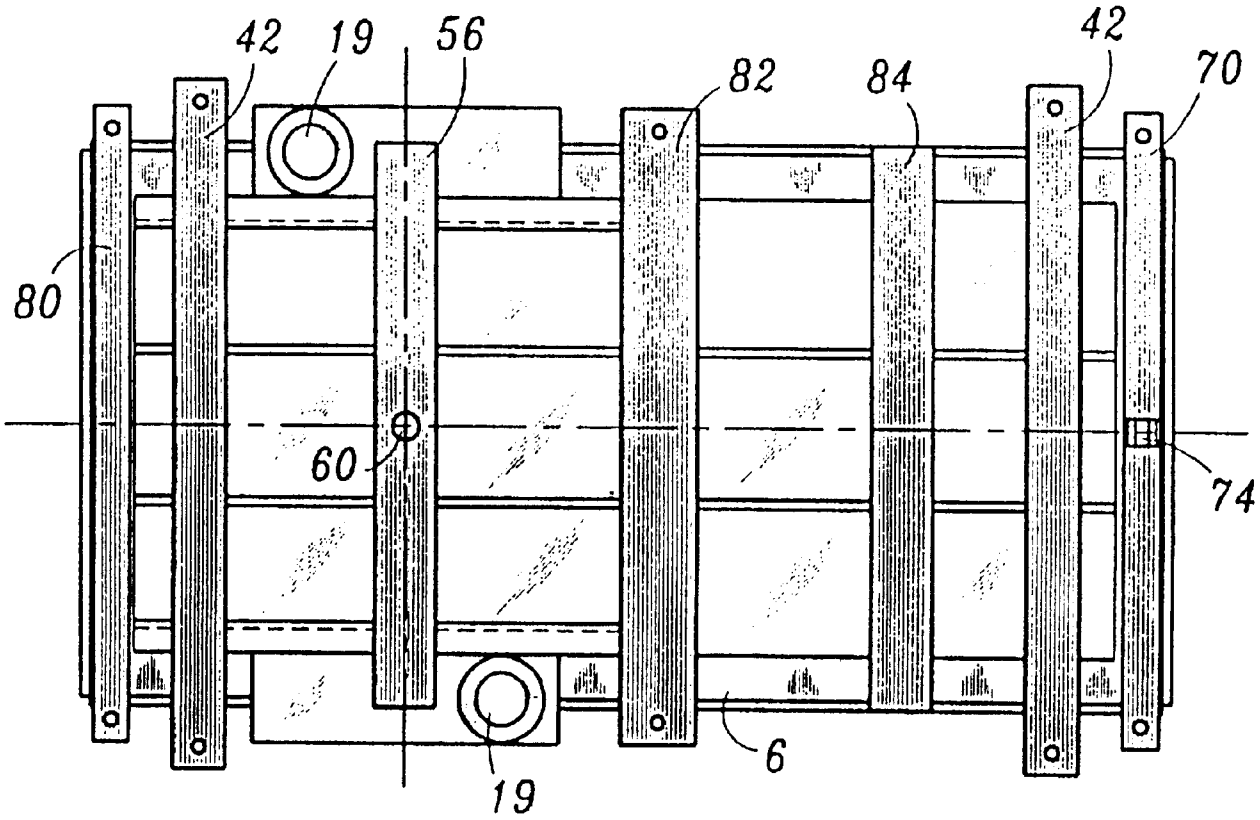
FIG. 4 is a plan view of the top in the direction of arrow IV in FIG. 1.

In order that the angular position of the frame 6 can also be fixed with respect to the base 40, the frame 6 includes at its right hand extremity as seen in FIG. 1 an additional horizontal centering cross-member 70 of square cross-section. This cross-member 70 includes in its wall 72 opposite the base 40, in the center thereof, a centering groove 74 (see FIG. 4) which acts with an additional centering pin 76 which is integral with the base 40. This centering groove 74 is also protected against unintended obstruction by a protective cover.

The frame 6 also includes horizontal cross-members 80, 82 and 84 of square cross-section on its underside which are designed to render the frame 6 integral with the base 40. Cross-members 80, 82 and 70 include holes in each of their lateral extremities designed to receive bolts which are fixed in the base 40 in order to render the frame/base assembly rigid after the frame 6 has been positioned with respect to the base 40.

The space between the cross-members 56 and 82, and that between the cross-members 82 and 84, is provided for the forks of a pallet transfer or so that the frame 6 can easily be removed together with the casting table 1 so that the siphon 9 of the device 3 supplying molten iron can be replaced.

As described earlier, the siphon 9 of the device 3 supplying liquid metal must be regularly replaced. For this purpose the lateral fixing bolts in the cross-members 80, 82 and 70 are unscrewed and the frame 6 is engaged by the forks of a pallet transfer or to move the assembly to another place so that the casting table assembly 1 can be dismantled. In order to do this, the fixing gudgeons 24 in the mountings 25 are released, so that the assembly comprising the support 15 with the die block, short columns 18 and jacks 21 can be lifted off. Then it is merely a matter of removing the tie bars 7 and the cross-members 8 in order to proceed with the replacement of the worn siphon 9.

In order to position the die block 5 of a casting table 1 whose siphon 9 has just been replaced, the short columns 18 are engaged in ball-bearing sockets 19. Then the free ends of the rods of the jacks 21 are secured in the mountings 25 using the gudgeons 24 and any movement in the latter is prevented by means of pins. Using a hydraulic unit 31, a certain tightening force is applied to the jacks 21 so that the die block 5 bears against the supply means 3 crushing the gaskets 12A, 12B, with the heating base 11 being placed between the die block 5 and the supply device 3. As a result of this first relative positioning the axis of revolution Y—Y of the die block 5 housed in the cooling block 17 is centered with respect to the centering hole 60 provided in the centering cross-member 56.

Then the frame 6 which bears the flanged support 15 is placed on the base 40 in such a way that the centering pin 64 engages the centering hole 60, the angular position of the frame 6 with respect to the base being fixed by the additional centering pin 76 which engages the centering groove 74. At this stage vertical extraction axis X—X and axis of revolution Y—Y of the die block 5 intersect in the vicinity of the centering pin 60. In order to make the two axes coincide it is then sufficient to adjust the frame 6 horizontally on the base 40 using the bolts 46. The position of the bolts 46 is then immobilized using the lock nuts 48. Finally, to make the assembly rigid, bolts are screwed through the lateral holes provided in the cross-members 80, 82 and 70 in the base 40.

The die can be aligned with respect to extraction axis X—X accurately and quickly by this means. As a result of this, downtime in the pipe casting system is greatly reduced.

What is claimed is:

1. A device for positioning a die block (5) of a casting table (1) of a machine for the continuous vertical ascendant casting of parts with respect to a vertical extraction axis (X—X), in which machine the die block (5) is fed through its lower end by means of a device (3) for the supply of liquid iron, wherein said positioning device comprises:

a retractable support (15) in which the die block (5) is fixed;

a removable frame (6) on which the device (3) supplying the liquid iron is placed;

means (18, 19) for relative positioning of the support (15) with respect to the frame (6);

immobilizing means (21, 25) designed to immobilize the relative position between the support (15) and the frame (6) in such a way that the support (15) and the frame (6) form an integral assembly;

a base (40) located in a predetermined fashion with respect to the vertical extraction axis (X—X) and designed to support the integral assembly; and means (60, 64, 47) for aligning the axis (Y—Y) of the die block (5) and the vertical extraction axis (X—X).

2. A device according to claim 1, wherein the means for relative positioning of the support (15) with respect to the frame (6) comprise at least two elongated members (18), which are integral with the support (15) and corresponding guide members (19) connected to the frame (6), each designed to receive an elongated member (18), or vice versa.

3. A device according to claim 1 wherein at least one immobilising member is a fluid-filled jack (21) connected to both the support (15) and the frame (6).

4. A device according to claim 3, wherein at least one end (23) of each jack (21) is connected to the support (15) and/or the frame (6) by means of a mounting (25) and a removable gudgeon (24) which secures the end of the jack (21) in the mounting (25).

5. A device according to claim 1 wherein the means of alignment comprise means (60, 64) for relative positioning of the frame with respect to the base and means (47) for horizontally adjusting the integral assembly.

6. A device according to claim 5, wherein the means for relative positioning of the frame with respect to the base comprise at least one centering member (64) integral with the base (40) and projecting therefrom in the direction of the frame (6) and a corresponding receiving member (60) integral with the frame (6), or vice versa.

7. A device according to claim 6, wherein the receiving member (60) which is integral with the frame (6) is aligned with the axis (Y—Y) of the die block (5), and that the at least one centering member (64) integral with the base (40) is aligned with the vertical extraction axis (X—X).

8. A device according to claim 5 wherein the means for horizontal adjustment comprise a plurality of supporting jacks (47) distributed over the underside of the integral assembly.

9. A device according to claim 8, wherein at least one supporting jack (47) is a screw jack.

10. A casting table of a machine for the continuous vertical ascendant casting of parts, the casting table (1) whose die block (5) is fed through its lower end by means of a device (3) for the supply of liquid iron, wherein said casting table comprises a positioning device in accordance with claim 1.

* * * * *